US007119509B1

(12) United States Patent
Keller et al.

(10) Patent No.: US 7,119,509 B1
(45) Date of Patent: Oct. 10, 2006

(54) SYSTEM AND METHOD FOR AUTOMATICALLY REQUIRING SECONDARY SAFETY SENSORS

(75) Inventors: Robert Keller, Chicago, IL (US); Colin Willmott, Buffalo Grove, IL (US)

(73) Assignee: The Chamberlain Group, Inc, Elmhurst, IL (US)

( * ) Notice: Subject to any disclaimer, the term of this patent is extended or adjusted under 35 U.S.C. 154(b) by 0 days.

(21) Appl. No.: 11/143,023

(22) Filed: Jun. 1, 2005

(51) Int. Cl.
*E05F 15/16* (2006.01)

(52) U.S. Cl. ..... 318/286; 318/266; 318/469; 49/26

(58) Field of Classification Search ..... 318/264–267, 318/286, 466–470; 49/26–28
See application file for complete search history.

(56) References Cited

U.S. PATENT DOCUMENTS

| | | | | |
|---|---|---|---|---|
| 3,789,419 | A * | 1/1974 | Shultz | 343/873 |
| 5,191,268 | A * | 3/1993 | Duhame | 318/266 |
| 6,002,332 | A * | 12/1999 | King | 340/545.1 |
| 6,075,333 | A * | 6/2000 | Huddle | 318/468 |
| 2004/0183677 | A1 * | 9/2004 | Fitzgibbon | 340/540 |

* cited by examiner

*Primary Examiner*—Bentsu Ro
(74) *Attorney, Agent, or Firm*—Fitch, Even, Tabin & Flannery

(57) ABSTRACT

A force reversal value for an installed barrier is identified. The force reversal value is compared to a predetermined threshold. When the comparing indicates that the force reversal value exceeds the predetermined threshold, the operation of the moveable barrier operator is halted. A secondary safety device can then be installed and, responsive to the installing, the operator can be reenabled.

19 Claims, 2 Drawing Sheets

START
302
RECEIVE SIGNAL
304
DETERMINE CHARACTERISTIC
306
308
310
311
316
DETERMINE FREQUENCY
DETERMINE CODE
DETERMINE DUTY CYCLE
DETERMINE IF ANY CONNECTION EXISTS
DETERMINE SIGNAL STRENGTH
312
SET INDICATOR
314
DETERMINE OTHER INFORMATION
END

SYSTEM AND METHOD FOR AUTOMATICALLY REQUIRING SECONDARY SAFETY SENSORS

FIELD OF THE INVENTION

The field of the invention relates to moveable barrier operators and, more specifically, to requiring secondary safety sensors in barrier operator systems.

BACKGROUND

Different types of moveable barrier operators have been sold over the years and these systems have been used to actuate various types of moveable barriers. For example, garage door operators have been used to move garage doors and gate operators have been used to open and close gates.

Such barrier movement operators may include a wall control unit, which is connected to send signals to a head unit thereby causing the head unit to open and close the barrier. In addition, these operators often include a receiver unit at the head unit to receive wireless transmissions from a hand-held code transmitter or from a keypad transmitter, which may be affixed to the outside of the area closed by the barrier or other structure.

Movable barrier operator systems often include safety sensors or devices. These safety sensors are used to detect obstructions in the path of travel of the barrier to provide increased safety of operation. Previous systems are programmed to react differently when the safety sensors are not attached. In some of these systems, the sensors must be detected by the operator before travel of the barrier is allowed.

In some situations, both primary and secondary safety sensors are used. For example, a primary sensor may determine when to reverse movement of the barrier and a secondary safety sensor used to verify the accuracy of the reading of the primary safety sensor. In some instances, the use of a secondary safety sensor is required.

Different countries have different standards with regards to requiring the use of secondary safety sensors. For example, some European standards require that an operator and barrier combination be tested to determine the force impacted on a strain gage that would cause a reversal of the movement of the barrier. If the force exceeds a threshold, then a secondary safety sensor is required to be installed. Unfortunately, using this approach, testing is required upon potentially every installation of a barrier operator. Since a test may need to be performed upon every installation, product cost, delays, and user frustration increase.

SUMMARY

A system and method are provided that automatically measure potential obstruction contact force and halt the operation of an operator until a secondary safety device becomes connected when the measured force exceeds a threshold. Consequently, safety standards that require the connection of secondary safety device are met. On the other hand, the approaches described herein do not require expensive and inconvenient manual testing of the need for a secondary safety sensor during the installation of the operator.

In many of these embodiments, a force reversal value for an installed barrier is identified. The force reversal value is compared to a predetermined threshold. When the comparing indicates that the force reversal value exceeds the predetermined threshold, the operation of the moveable barrier operator is halted. A secondary safety device can then be installed and, responsive to the installing, the operator can be reenabled.

In accordance with the principles described herein, the force reversal value can be determined in a variety of ways. In one example, a mass of the barrier and a speed representative of a force may be identified. In another example, a motor current at a threshold may be identified. In still another example, a speed and a rate of change of the speed of the barrier may be measured. Furthermore, an impact force may be measured, for example, by using a strain gage.

Thus, a system and method are provided that automatically determine when a secondary safety sensor is needed but not connected to the operator and halt the operation of the operator until the secondary safety device becomes connected. Consequently, safety standards that require the use of a secondary safety device are met. On the other hand, expensive and inconvenient manual testing is avoided.

Skilled artisans will appreciate that elements in the figures are illustrated for ease of understanding and have not necessarily been drawn to scale. For example, the dimensions of some of the elements in the figures may be exaggerated relative to other elements to help to improve understanding of various embodiments of the present invention. Also, common but well-understood elements that are useful in a commercially feasible embodiment are often not depicted in order to facilitate a less obstructed view of the various embodiments of the present invention.

DESCRIPTION

Figure 1:
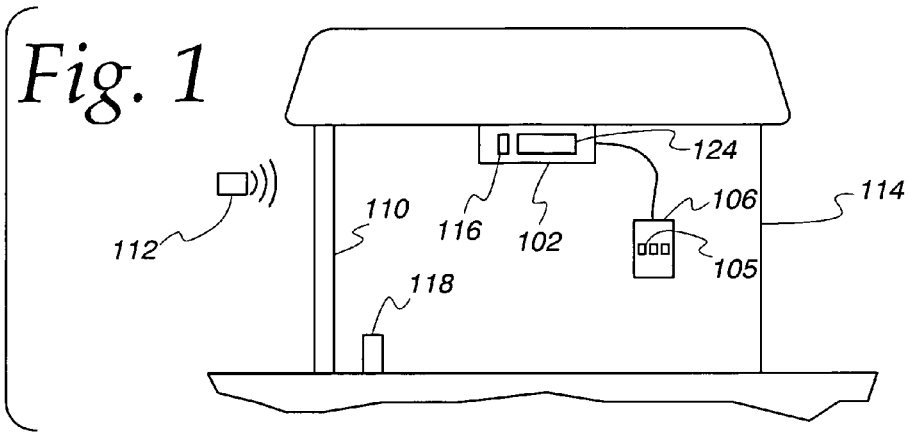
FIG. 1 is a block diagram showing one example of a system for automatically requiring a secondary safety device according to the present invention.

Referring now to the drawings and especially FIG. 1, a system and method for automatically requiring the connection of secondary safety sensors to a moveable barrier operator is described. An operator 102 is positioned in a garage 114. In this case, the operator 102 is a garage door opener. However, the operator 102 may be any type of moveable barrier operator such as a gate operator or swinging door operator. The operator 102 is used to move the barrier 110, which, in this case is a garage door. However, the barrier 110 may be a garage door, a swinging gate, a sliding gate, a swinging door, shutters, or any other type of barrier. Other examples of barriers and barrier operators are possible.

The operator 102 includes a controller 124. The controller 124 receives signals from sensors 116 and 118, and a handheld transmitter 112. The handheld transmitter 112 transmits coded or uncoded signals that are received at the operator 102 and used to actuate the operator 102.

The sensors 116 and 118 may be any type of safety sensors or devices. For example, the sensors 116 or 118 may be current measurement devices, speed sensors, acceleration sensors, door edge detectors, photo beam detectors, radar detectors, capacitive sensors, or area detectors. Other examples of sensors are possible. The sensors 116 and 118 can be positioned at a variety of heights and can be internal or external to the garage 114. The sensors 116 and 118 can also be wired or wireless and used together (or with other further sensors or devices) as part of a larger sensing system or systems.

The sensors 116 and 118 may be used as either primary or secondary safety devices. In one example, the sensor 116 may provide a primary safety sensor or system that identifies a force reversal value needed to cause a reversal of movement of the barrier 110. The force reversal value may represent a force above which significant damage to the barrier 110 may occur. As mentioned, multiple sensing sensors or devices (e.g., a current sensing device and photo beam detector) may be connected together and used as a primary safety system. Other examples of force measuring devices and systems are possible.

In this example, the force reversal value is a reading that is either directly or indirectly representative of force (e.g., speed, barrier mass, motor current, acceleration, or actual force). In other examples, more than one force reversal value can be obtained. For instance, a mass of the barrier 110 and a speed representative of a force may both be identified.

The value or values representative of force are received from the primary safety sensor by the controller 124 and converted into a force value. This force value can then be compared to a predetermined threshold to determine if the operation of the operator 102 should be halted until a secondary safety sensor is connected.

In the present example, the sensor 118 may be connected to provide a secondary safety sensor or used as part of a secondary safety system. For instance, if the primary safety sensor or system causes reversal of the movement of the barrier, the sensor 118 may be a photo beam detector and used to supplement the primary safety sensor or system, for instance, the sensor 116.

A wall control unit 106 with buttons 105 is coupled to the operator over link 106. The wall control unit 106 may be used to program the operator 102 or to operate the operator 102. For instance, the buttons 105 may provide functions that allow a user to open and close the barrier 110.

In one example of the operation of the system of FIG. 1, it is determined whether a second safety device, such as the sensor 118, has been connected to the operator 102. To be connected, one or more parameters related to the sensor or signals produced by the sensor can be evaluated. For instance, an indication of whether a sensor has been previously learned or a signal strength can be used to determine if a sensor is connected.

If the sensor is wireless, a variety of tests can be performed to determine if it has been connected to the operator 102. In one example, a frequency or frequency range can be checked to determine if a wireless sensor assigned that range is connected. In still another example, a code transmitted in a signal can be evaluated to determine if the code has been pre-assigned to a wireless sensor. In yet another example, a timing pattern (e.g., coded data) of a signal can be evaluated to determine if the wireless sensor is connected. More than one of parameters (e.g., signal strength and frequency) can be evaluated to determine if the wireless sensors are connected. These approaches determine if the wireless sensor is functionally connected to the operator 102 and not merely present near the operator 102. For instance, a weak signal may be detected that indicates the wireless sensor is present but not properly connected to the operator 102.

A force reversal value for the barrier 110 is identified as described previously by a primary safety sensor or system (e.g., sensor 116). The force reversal value is compared to a predetermined threshold. When the comparing indicates that the force reversal value exceeds the predetermined threshold, the operation of the moveable barrier operator 102 is halted. A secondary safety device (e.g., sensor 118) can then be installed and, responsive to the installing, the operator 102 can be reenabled.

Figure 2:
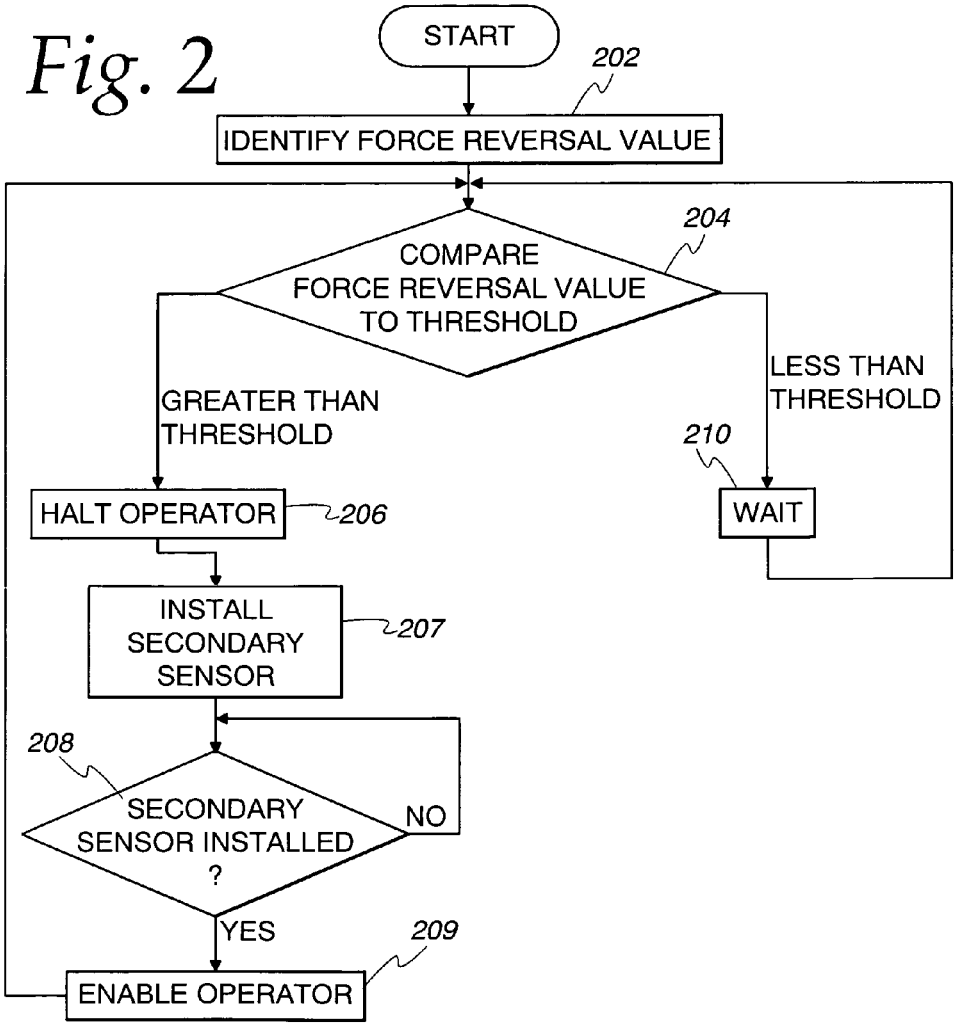
FIG. 2 is a flow chart showing an approach for automatically requiring a secondary safety device according to the present invention.

Referring now to FIG. 2, one example of an approach for automatically requiring the use of a secondary safety sensor or device is described. At step 202, a force reversal value for an installed barrier is identified as described previously. At step 204, the force reversal value is compared to a predetermined threshold. When the comparing indicates that the force reversal value exceeds the predetermined threshold, at step 206, the operation of the moveable barrier operator is halted. At step 207, a secondary safety device can be installed. At step 208, it is determined if the secondary safety device has been properly connected. If the answer is affirmative, at step 209, the operator can be reenabled. Execution can then continue at step 204 and continue as described above. If the answer at step 208 is negative, execution returns to step 208.

If, at step 204, the comparing indicates that the force reversal value does not exceed the threshold, the system may wait for a predetermined amount of time at step 210 before returning to step 204. Execution then continues as described above.

Figure 3:
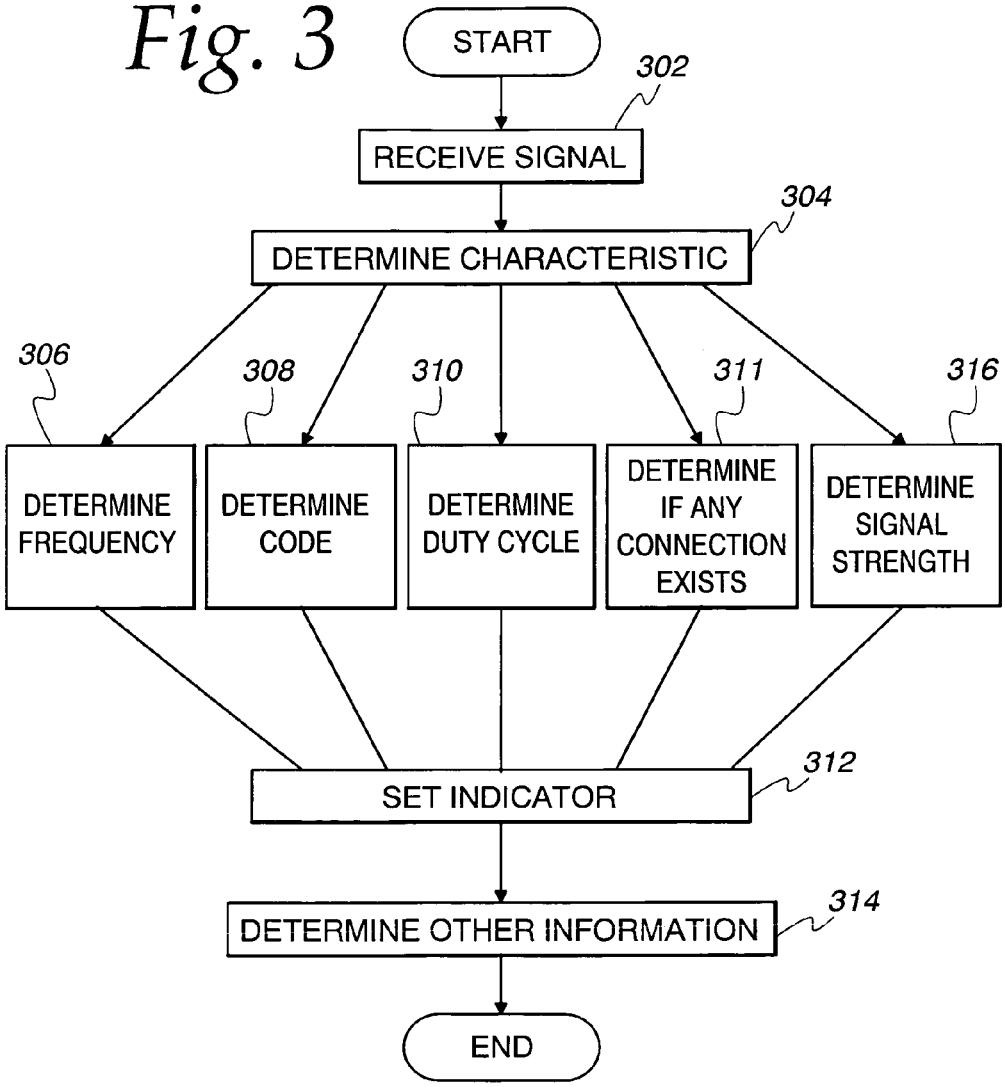
FIG. 3 is a flow chart of an approach for determining whether a secondary safety sensor is connected to an operator according to the present invention.

Referring now to FIG. 3, one example of an approach for determining whether a secondary safety sensor is connected to the operator is described. In this example, the secondary safety sensor may be wired or wireless although it will be realized that some identification techniques (described below) may be better suited for identifying one particular sensor type over another type. At step 302, a signal is received. At step 304, characteristics of the signal are determined. These characteristics may include the frequency of the signal (e.g., a certain frequency or frequency range indicates the signal originates from a secondary sensor); timing patterns of the signal (e.g., the duty cycle of the signal indicates that the signal originates from a secondary sensor); the informational content of the signal (e.g., the presence of a predefined code indicating the signal originates from a secondary sensor); the signal strength of the signal; or the mere presence of an electrical signal indicating a secondary safety sensor. Other characteristics may also be used to determine whether the secondary sensor is connected to the operator.

Based upon which characteristic or characteristics of the signals that are being used to determine the source of the signal, one or more of steps 306, 308, 310, and 311, and 316 are executed. Step 306 is executed when frequency is a determining characteristic and, at this step, it is determined whether the frequency of the signal is within a certain range or is of a certain value. If the answer is affirmative (of a certain frequency or with a certain frequency range), then the signal is deemed to be connected.

Step 308 is executed when the code contained within the signal is a determining characteristic and, with this step, it is determined if a code extracted from the signal matches or is close enough in value codes that are known to originate from particular sensors. If a code match is determined to exist, then the sensor is deemed to be connected.

Step 310 is executed when the on-off time (i.e., duty cycle) is a determining characteristic. At step 310, it is determined if a particular on-off time is characteristic of a signal known to originate from secondary sensors. If the answer is affirmative, then the sensor is deemed to be connected.

Step 311 may be executed when the existence of any electrical connection with the secondary safety sensor is a determining characteristic. In this case, the existence of any electrical signal indicates the connection of a secondary safety sensor.

Step 316 is executed when the signal strength is a determining characteristic. At step 316, it is determined if a particular signal strength is above a predetermined level known to originate from sensors. If the answer is affirmative, then the sensor is deemed to be connected. This step is preferably performed with others of the steps 306, 308 and 310 and, in this case, is used to verify that the signal is of sufficient strength to perform further processing.

It is possible that only one of the steps 306, 308, 310, 311, and 316 are present and performed. On the other hand, different combinations of the steps 306, 308, 310, 311, and 316 may be used to determine within a high level of certainty whether a secondary safety sensor is connected. In addition, other steps not described herein may also be performed.

In one example of multiple steps being used to determine whether a secondary safety sensor is connected to the operator, steps 306 and 308 may both be performed. In this case, the system looks at both the frequency and the code contained in the received signal. In some situations the frequency may fall outside a frequency range even though the code indicates that the signal is from a secondary sensor. This may be the result of interference or some other environmental factors. In this example, the system may confirm that the signal is from a secondary sensor even though it lies outside of the frequency range because the code match is obtained. In this case, the sensor is deemed connected.

In another example, step 316 may be used to determine if the signal strength meets minimum requirements to process the signal. Then, steps 306 and 308 may be used as described above to confirm the sensor is connected. In another example, it may be determined if a sensor has been previously learned and then steps 306 and 308 may be performed. Other examples of weighting the other factors are possible.

At step 312, if any combination of the steps 306, 308, 310, 311, and 316 have identified that a secondary safety sensor is connected, a flag or other indicator is set. This flag or indicator may be used by the approaches described herein to determine when to restart or reenable an operator. At step 314, any other information needed to be extracted from the signal is obtained. For example, information representing signal strength or a value of the signal may be extracted for later use.

Thus, a system and method is provided that are provided that automatically determines when a secondary safety sensor is not connected to the operator and halts the operation of the barrier until the secondary safety device becomes connected. Consequently, safety standards that require the secondary safety device be attached are met. On the other hand, the approaches described herein do not require expensive and inconvenient testing during the installation of operators.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

What is claimed is:

1. A method of operating a moveable barrier operator comprising:

identifying a force reversal value for an installed barrier;

comparing the force reversal value to a predetermined threshold;

when the comparing indicates that the force reversal value exceeds the predetermined threshold, halting an operation of the moveable barrier operator;

installing a secondary safety device;

responsive to the installing, reenabling the operator; and adjusting a speed of the operator when the comparing indicates that the force exceeds the threshold.

2. The method of claim 1 wherein identifying a force reversal value comprises measuring a mass of the barrier and a speed representative of a force.

3. The method of claim 1 wherein identifying a force reversal value comprises measuring a motor current at a threshold.

4. The method of claim 1 wherein identifying a force reversal value comprises measuring a speed and a rate of change of the speed.

5. The method of claim 1 wherein identifying a force reversal value comprises measuring an impact force.

6. The method of claim 5 wherein measuring the impact force comprises measuring the impact force applied to a strain gage.

7. The method of claim 1 wherein installing the secondary safety device comprises connecting a secondary safety device to the operator, the secondary safety device being selected from a group comprising: a door edge detector; a photo beam detector; a radar detector; a capacitive sensor; and an area detector.

8. An operator comprising:

a force measuring device; and a controller coupled to the force measuring device, the controller programmed to receive information indicative of an force applied to an object in a path of a moveable barrier from the force measuring device and to determine the force from the information, the controller being further programmed to make a comparison of the force to a predetermined threshold, and, when the comparison indicates that the force exceeds the threshold, to halt an operation of the operator until the controller determines that a secondary safety device has become connected to the operator.

9. The operator of claim 8 wherein the information comprises data indicative of a mass of the barrier and a speed representative of force.

10. The operator of claim 8 wherein the information comprises data indicative of a motor current at a threshold.

11. The operator of claim 8 wherein the information comprises data indicative of a speed and a rate of change of the speed.

12. The operator of claim 8 wherein the information comprises data indicative of an impact force.

13. The operator of claim 12 wherein the impact force comprises the impact force applied to a strain gage.

14. The operator of claim 8 wherein the controller is further programmed to adjust a speed of the operator when the comparison indicates that the force exceeds the threshold.

15. A system for operating a moveable barrier comprising:

at least one sensor for determining a speed of the barrier;

a barrier; and a barrier operator coupled to the barrier and the at least one sensor, the barrier operator being programmed to receive the speed of the barrier and to convert the speed to a value representative of a force, the operator being further programmed to make a comparison of the value representative of the force to a predetermined threshold, and, when the comparison indicates that the value exceeds the threshold, to halt an operation of the operator until the operator detects that a secondary safety device has become connected to the operator.

16. The system of claim 15 wherein the barrier is selected from a group comprising a garage door, a swinging door, a sliding gate, a swinging gate, and shutters.

17. The system of claim 15 wherein the barrier operator is selected from a group comprising a garage door operator and a gate operator.

18. The system of claim 15 wherein the barrier operator is further programmed to adjust the speed of the operator when the comparison indicates that the value of the force exceeds the threshold.

19. The system of claim 15 wherein the at least one sensor is selected from a group comprising: a door edge detector; a photo beam detector; a radar detector; a capacitive sensor; and an area detector.

* * * * *